US006959884B2

(12) United States Patent
Lacchia

(10) Patent No.: US 6,959,884 B2
(45) Date of Patent: Nov. 1, 2005

(54) TRIBOELECTRIC SPRAYER

(75) Inventor: Adrien Lacchia, Saint Martin le Vinoux (FR)

(73) Assignee: Eisenmann France Sarl, (FR)

( * ) Notice: Subject to any disclaimer, the term of this patent is extended or adjusted under 35 U.S.C. 154(b) by 0 days.

(21) Appl. No.: 10/467,539

(22) PCT Filed: Feb. 5, 2002

(86) PCT No.: PCT/FR02/00437

§ 371 (c)(1),
(2), (4) Date: Aug. 7, 2003

(87) PCT Pub. No.: WO02/062487

PCT Pub. Date: Aug. 15, 2002

(65) Prior Publication Data

US 2004/0069870 A1 Apr. 15, 2004

(30) Foreign Application Priority Data

Feb. 8, 2001 (FR) ..... 01 01737

(51) Int. Cl.[7] ..... B05B 5/00

(52) U.S. Cl. ..... 239/690; 239/704; 239/706; 239/428; 239/433

(58) Field of Search ..... 239/3, 692, 704, 239/706, 696, 400, 427.5, 428, 433, 690

(56) References Cited

U.S. PATENT DOCUMENTS

| | | | | |
|---|---|---|---|---|
| 4,114,564 A * | 9/1978 | Probst | 118/626 |
| 4,747,546 A | 5/1988 | Talacko | |
| 4,798,340 A * | 1/1989 | Vohringer et al. | 239/692 |
| 5,622,313 A * | 4/1997 | Lader et al. | 239/3 |
| 6,082,628 A * | 7/2000 | Hutchins | 239/3 |

FOREIGN PATENT DOCUMENTS

| | | |
|---|---|---|
| EP | 0 163 118 | 12/1985 |
| EP | 0 199 054 | 10/1986 |
| EP | 0 314 049 | 5/1989 |
| EP | 0 592 137 | 4/1994 |
| EP | 0 818 245 | 1/1998 |
| WO | WO 88/08332 | 11/1988 |
| WO | WO 92/11950 | 7/1992 |
| WO | WO 98/25707 | 6/1998 |

* cited by examiner

*Primary Examiner*—Dinh Q. Nguyen
(74) *Attorney, Agent, or Firm*—Cantor Colburn LLP

(57) ABSTRACT

The invention concerns a triboelectric sprayer for spraying electrostatic powder paint, comprising a powder intake, an air intake, a conduit transporting air and powder while providing the electrical charge of the powder and, in front of the charging conduit, means for emitting at least an air-powder mixture jet. The air intake is located in the axis of the charging conduit, while the powder intake is arranged laterally and converges in an acute angle with the air intake, in a point located upstream of the charging conduit. The air intake includes of an injector made of electrically conductive material which also constitutes an earthing member of the wall of the charging conduit.

8 Claims, 3 Drawing Sheets

TRIBOELECTRIC SPRAYER

BACKGROUND OF THE INVENTION

The present invention relates to a triboelectric spray gun for the electrostatic spraying of powder paint.

The principle of a triboelectric spray gun for the electrostatic spraying of powder paint and the following.

The paint, in insulating powder form, conveyed by "transport" air, is electrostatically charged by friction against an insulating material, capable of withdrawing electrons therefrom, so that the powder becomes positively charged.

As is generally known, a triboelectric spray gun operating according to this principle comprises:

a powder intake, an air intake, a duct transporting the air and the powder, while ensuring that the powder becomes electrically charged; and in front of said charging duct means for emitting at least one jet of air/powder mixture.

The insulating material, ensuring that the powder becomes electrostatically charged by friction, forms the wall of the aforementioned duct that transports the air and powder. This insulating material is electrically connected to ground via joints between components of the spray gun, so that it remains overall electrically neutral, its charge permanently flowing away by "creep" (flow over the surface), to ground. Of course, the higher the friction force between the powder and the walls of the charging duct, the greater or better the electrical charging of the powder.

Many documents have already described this kind of triboelectric spray gun. As examples, mention may be made here of European Patent Application EP 0 163 118, EP 0 199 054, EP 0 314 049, EP 0 592 137 and EP 0 818 245, or else International Patent Applications WO 88/08332, WO 92/11950 and WO 98/25707.

Most of the triboelectric spray guns described in those documents have, as charging ducts, a relatively elongate annular space bounded by parts against which the powder transported by the air will rub and be charged. The annular charging duct is bounded internally by a central core that advantageously has, in profile, a wavy shape (see in particular the aforementioned documents EP 0 314 049 (FIG. 3), EP 0 592 127 and WO 92/11950) so as to increase the stirring of the powder, and therefore to facilitate its contact with the insulating material provided for charging it. The central core is held in place inside an external body, by which the charging duct is bounded externally, by centering elements mounted at each end of said duct. This central core may have a conical end on the side on which the inlet of the charging duct lies, so as to distribute the powder in the annular space forming this duct; the other end of the central core, located on the side on which the outlet of the charging duct lies, may also be of conical shape, so as to collect the charged powder before it is sent into small outlet channels belonging to or associated with the means for emitting jets of air/powder mixture, these means being in practice formed by a nozzle.

As is usual, in the rear part of the triboelectric spray gun, an air intake is formed along the central axis of this spray gun. However, in most known constructions, an additional intake for air, and if necessary for powder, is placed so as to be orthogonal to the central axis of the spray gun, upstream of the entry cone of the charging duct—see for example the aforementioned documents EP 0 592 137 and EP 0 818 245. The presence of an obstacle-forming "orthogonal" injection means creates perturbations; in particular, it is the cause of premature wear and/or of powder building up at the stagnation point.

Moreover, in current triboelectric spray guns, the grounding, especially of the central core of the charging duct, requires the addition of parts that complicate the set-up; this grounding is generally made around the external periphery and toward the rear of the body of the spray gun. Owing to the electrical forces and fields employed by the charges created, it is frequently observed that arcing occurs between the inner portion of the spray gun and its grounding region, and this leads to parts that are not, per se, wear parts having to be replaced relatively frequently.

BRIEF SUMMARY OF THE INVENTION

The present invention aims to avoid all these drawbacks of current triboelectric spray guns, by providing an air and powder intake system that avoids any wear and powder build-up, while simplifying the grounding.

For this purpose, provision is made, in the triboelectric spray gun forming the subject of the invention, of the type indicated in the introduction, for:

the air intake to be located on the axis of the charging duct;

the powder intake to be placed laterally and to converge, at an acute angle to the air intake, at a point located upstream of the charging duct.

Thus, any injection member forming an obstacle to the flow is eliminated, the air and powder intakes converging, at an acute angle, before the air/powder mixture reaches the turbulent charging region.

Advantageously, the powder intake, converging with the air intake, is formed by a powder duct that emerges on the rear face of the spray gun, thereby reducing the size and making the connections easier.

According to one embodiment of the triboelectric spray gun forming the subject of the invention, the charging duct is a duct whose circular cross section is not constant, having successive restrictions, the point of convergence of the powder and air intakes being located upstream of the first restriction in the charging duct. The choice of such a charging duct may have advantages compared with a charging duct of annular cross section, especially as regards a certain constructional simplification (the central core is eliminated) and an improvement in the operation (the risk of the annular space being blocked by the powder is eliminated).

However, the invention remains compatible with a triboelectric spray gun in which the charging duct is a duct of annular cross section, having a central core with a rear cone, in which case the point of convergence of the powder and air intakes is located upstream of the apex of said cone.

In all cases, cross sectional restrictions provided along the charging duct make it possible to create regions of impact by the powder on the insulating material, thereby charging it. More particularly, if the charging duct has an annular cross section, this annular cross section is not constant, it having successive restrictions.

In addition, a throttling region is advantageously provided downstream of the charging duct, said throttling region terminating in a homogenizing chamber from which the means for emitting at least one jet of air/powder mixture are fed. The latter restriction makes it possible to accelerate the air/powder mixture so as to put the powder back into a homogeneous suspension before it is delivered to the outlet channels.

According to another aspect of the invention, the axial air intake is formed by an injector made of an electrically conducting material, thus forming a grounding member. This arrangement makes it possible to simplify the grounding function, the electric charges picked up from the powder flowing away through the air injector.

BRIEF DESCRIPTION OF THE DRAWINGS

The invention will be more clearly understood with the aid of the description that follows, with reference to the appended schematic drawings showing, by way of examples, a few embodiments of this triboelectric spray gun.

BRIEF DESCRIPTION OF THE INVENTION

Figure 1:
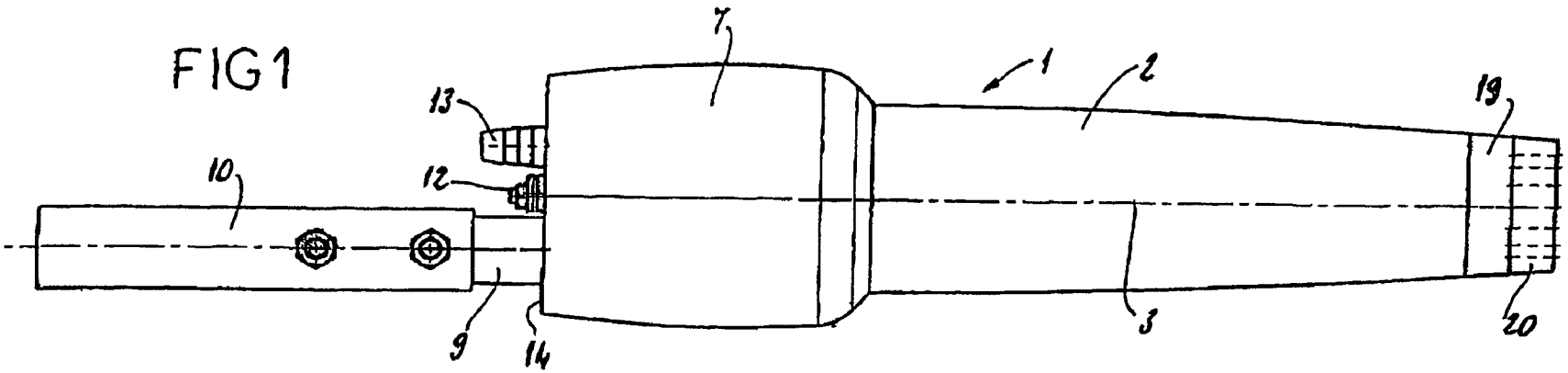
FIG. 1 is a side view, from outside, of a triboelectric spray gun according to the present invention.
Figure 2:
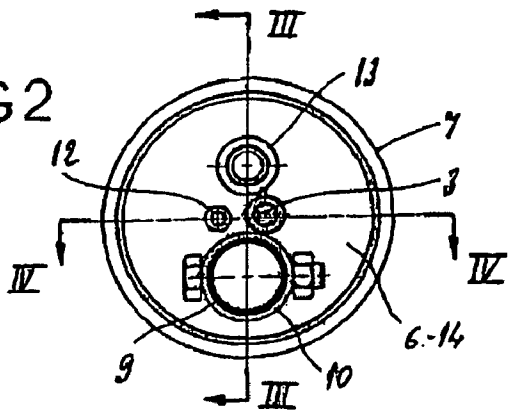
FIG. 2 is an end view, from the rear, of the triboelectric spray gun of FIG. 1.
Figure 3:
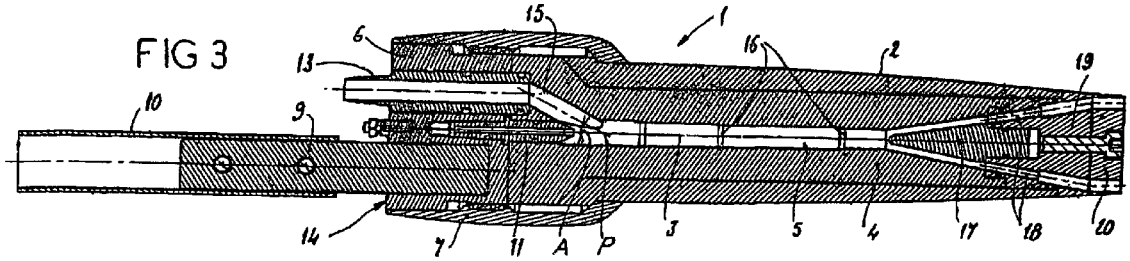
FIG. 3 is a longitudinal sectional view of this spray gun of III—III in FIG. 2.
Figure 4:
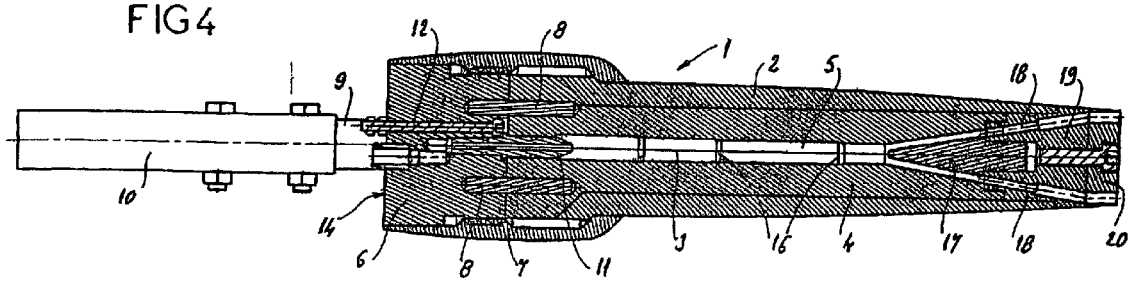
FIG. 4 is another longitudinal sectional view, on IV—IV in FIG. 2.

The triboelectric spray gun shown in FIGS. 1 to 4 and denoted overall by the reference 1 comprises a main body 2, of tubular general shape with a central axis indicated at 3, in which an elongate block 4 of insulating material is placed, defining a charging duct 5 centered on the axis 3. In the example in question, the charging duct 5 is of circular cross section.

Provided at the rear of the main body 2 is an injection base 6, mechanically coupled to said body 2 via a screwable linking sleeve 7, and with the interposition of centering pins 8. The injection base 6 is itself mechanically coupled, via a fastening pin 9, to the end of a movable arm 10 (shown in part) belonging to a painting robot, the spray gun 1 being carried and moved by the robot arm 10.

In the junction region between the charging duct 4, 5 and the base 6, and lying along the central axis 3, there is an air injector 11. This injector 11 is made of a material that is electrically conducting and also has a high friction coefficient, such as graphitized polytetrafluoroethylene (PTFE), and it is grounded. For this purpose, a grounding screw 12 is provided in the base 6, the head of the screw coming into contact with a flange of the air injector 11 (see FIG. 4).

An air/powder mixture intake fitting 13 is also mounted in the injection base 6, parallel to the central axis 3, and therefore in a lateral position with respect to the air injector 11. The fitting 13 thus emerges on the rear face 14 of the base 6.

The fitting 13 is extended, to the front, by a short oblique channel 15 that converges, at an acute angle A, at a point P, on the inlet of the charging duct 4, 5 just downstream of the air injector 11.

Thus, during operation, the air injector 11 makes it possible to stir the air/powder mixture that emerges in the inlet of the charging duct 4, 5 via the oblique channel 15. The assembly allows a rapid and turbulent flow to be created in the charging duct 4, 5, preventing any laminar flow that would have the effect of reducing the friction needed for electrostatically charging the powder.

In addition, restrictions 16 placed in succession along the charging duct 4, 5, that is to say reductions in the diameter, and therefore in the circular cross section of this duct, create regions of impact by the powder which improve the friction of the latter on the material of the block 4 defining the actual charging duct 5.

At the downstream end of the charging duct 4, 5 there is an outlet cone 17 that makes it possible to deliver the air/powder (now charged) into outlet channels 18 provided in an ejection nozzle 19 fitted in front of the spray gun 1. The nozzle 19 itself receives an outlet plug 20, the configuration of which depends on the type of jet desired at the outlet of the spray gun, for example a flat jet.

Figure 5:
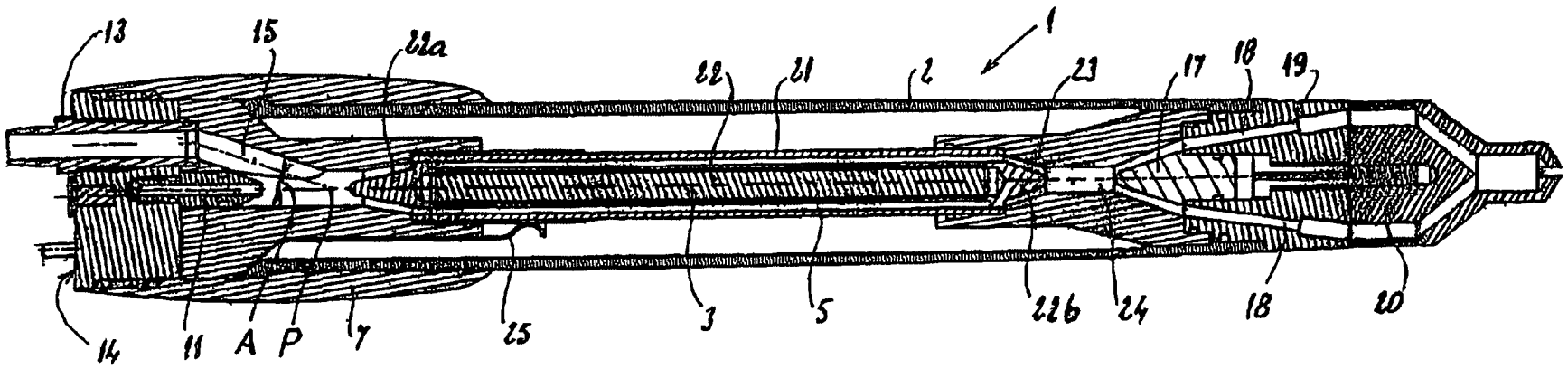
FIG. 5 is a longitudinal sectional view, similar to FIG. 3, of an alternative embodiment of this triboelectric spray gun.

FIG. 5, in which the components corresponding to those described above are denoted by the same references, shows an alternative embodiment of the triboelectric spray gun 1 that is the subject of the invention.

In particular, in this alternative embodiment, there are still provided an air injector 11, located on the central axis 3 of the spray gun 1, and an air/powder mixture intake fitting 13 placed laterally and extended by an oblique channel 15, which converges at a point P with the outlet of the air injector 11, making an acute angle A with the axis 3.

Unlike the embodiment shown in FIGS. 1 to 4, the embodiment in FIG. 5 has a charging duct 5 of annular (and not circular) cross section, this being bounded on the outside by a tube 21 and on the inside by a central core 22, the tube 21 and the central core 22 being coaxial and centered on the axis 3.

The central core 22 has a rear cone 22*a* located downstream of the point P where the oblique channel 15 converges with the outlet of the air injector 11.

The charging duct 5 has, here again, successive restrictions (not detailed in FIG. 5) that give it an annular cross section that decreases from the upstream end toward the downstream end.

The central core 22 also has a front cone 22*b*, surrounded by a throttling region 23 that extends the charging duct 5, with a decreasing cross section, and that emerges in a central homogenizing chamber 24. Downstream of this homogenizing chamber 24 there is an outlet cone 17 that delivers the air/powder (now charged) mixture into outlet channels 18 of an ejection nozzle 19 which is itself provided with an outlet plug 20, for example designed to emit a flat jet.

It should be noted that, in this embodiment, the grounding of the tube 21, by which the charging duct 5 of annular cross section is bounded on the outside, is accomplished by means of a contact blade 25.

In all cases, unscrewing the linking sleeve 7 allows the base 6 to be rapidly removed, especially for cleaning purposes, this sleeve 7 being mounted with the interposition of O-ring seals (not detailed).

The number and the arrangement of the pins 8 and 9, or the configuration of the outlet plug 20, can be modified without thereby departing from the scope of the invention, as defined in the claims appended hereto.

What is claimed is:

1. A triboelectric spray gun for the electrostatic spraying of powder paint, of the kind comprising:

a powder intake;

an air intake;

a charging duct transporting air and powder, while ensuring that the powder becomes electrically charged;

in front of said charging duct, means for emitting at least one jet of air/powder mixture;

wherein, the air intake is located on an axis of the charging duct; and the powder intake is placed laterally and converges, at an acute angle to the air intake, at a point located upstream of the charging duct and downstream of the air intake.

2. The triboelectric spray gun as claimed in claim 1, wherein the powder intake, converging with the air intake, is formed by a powder duct that emerges on a rear face of the spray gun.

3. The triboelectric spray gun as claimed in claim 1, wherein the charging duct is a duct whose circular cross section is not constant, having successive restrictions, the point of convergence of the powder intakes and air intake being located upstream of a first restriction in the charging duct.

4. The triboelectric spray gun as claimed in claim 1, wherein the charging duct is a duct of annular cross section, having a central core with a rear cone, the point of convergence of the powder intakes and air intake being located upstream of an apex of said cone.

5. The triboelectric spray gun as claimed in claim 4, wherein the annular cross section of the charging duct is not constant, having successive restrictions.

6. The triboelectric spray gun as claimed in claim 1, wherein the axial air intake is formed by an injector made of an electrically conducting material, thus forming a grounding member.

7. The triboelectric spray gun as claimed in claim 1, wherein a throttling region is provided downstream of the charging duct, said throttling region terminating in a homogenizing chamber from which the means for emitting at least one jet of air/powder mixture are fed.

8. A triboelectric spray gun for the electrostatic spraying of powder paint, of the kind comprising:

powder intake;

an air intake;

a charging duct transporting air and powder, while ensuring that the powder becomes electrically charged;

in front of said charging duct, means for emitting at least one jet of air/powder mixture;

wherein, the air intake is located on an axis of the charging duct; and the powder intake is placed laterally and converges, at an acute angle to the air intake, at a point located upstream of the charging duct; and the powder intake, is formed by a powder duct that emerges on a rear face of the spray gun.

* * * * *